US008371231B2

(12) United States Patent
Kumar et al.

(10) Patent No.: US 8,371,231 B2
(45) Date of Patent: Feb. 12, 2013

(54) LOCOMOTIVE TRUCK AND METHOD FOR DISTRIBUTING WEIGHT ASYMMETRICALLY TO AXLES OF THE TRUCK

(75) Inventors: Ajith Kuttanair Kumar, Erie, PA (US); Bret Dwayne Worden, Erie, PA (US)

(73) Assignee: General Electric Company, Schenectady, NY (US)

( * ) Notice: Subject to any disclaimer, the term of this patent is extended or adjusted under 35 U.S.C. 154(b) by 101 days.

(21) Appl. No.: 12/712,469

(22) Filed: Feb. 25, 2010

(65) Prior Publication Data

US 2010/0170413 A1 Jul. 8, 2010

Related U.S. Application Data

(63) Continuation-in-part of application No. 11/833,819, filed on Aug. 3, 2007, now abandoned.

(51) Int. Cl.
*B61C 15/04* (2006.01)

(52) U.S. Cl. ..... 105/75; 105/73

(58) Field of Classification Search ..... 105/34.1, 105/34.2, 75, 82, 194, 209, 73
See application file for complete search history.

(56) References Cited

U.S. PATENT DOCUMENTS

| | | | |
|---|---|---|---|
| 598,403 | A | 2/1898 | Uebelacker |
| 1,020,607 | A | 3/1912 | Hunt |
| 3,908,559 | A | 9/1975 | Fromm |
| 4,399,881 | A | 8/1983 | Theurer et al. |
| 4,809,616 | A | 3/1989 | Piel |
| 6,267,062 | B1 | 7/2001 | Hamilton |
| 2007/0001629 | A1 | 1/2007 | McGarry et al. |

FOREIGN PATENT DOCUMENTS

| | | | |
|---|---|---|---|
| DE | 10 35 681 | B | 8/1958 |
| FR | 1 279 890 | A | 12/1961 |
| FR | 1289 653 | A | 4/1962 |
| FR | 2 430 880 | A | 2/1980 |
| GB | 562 542 | A | 7/1944 |
| GB | 1 116 012 | A | 6/1968 |
| JP | 2006 137238 | A | 6/2006 |
| RU | 2007316 | C1 | 2/1994 |
| SU | 1 525 056 | A1 | 11/1989 |

*Primary Examiner* — S. Joseph Morano
*Assistant Examiner* — Zachary Kuhfuss
(74) *Attorney, Agent, or Firm* — GE Global Patent Operation; John A. Kramer

(57) ABSTRACT

A locomotive (or other rail vehicle) truck and method for distributing weight asymmetrically to axles of the truck includes a first axle of a truck uncoupled from a traction system of the locomotive and a first suspension assembly coupling the first axle to the truck for applying to the first axle a first portion of a locomotive weight. The truck also includes a second axle coupled to the traction system and a second suspension assembly coupling the second axle to the truck for applying a second portion of the locomotive weight to the second axle that is greater than the first portion so that weight is asymmetrically distributed to the first axle and the second axle so as to transmit a corresponding incremental amount of tractive effort for a given amount of a driving torque applied to the second axle via the traction system of the locomotive. The axle weight distribution involves relatively slight weight distribution compared to the nominal weights normally carried by the axles.

9 Claims, 3 Drawing Sheets

LOCOMOTIVE TRUCK AND METHOD FOR DISTRIBUTING WEIGHT ASYMMETRICALLY TO AXLES OF THE TRUCK

RELATED APPLICATIONS

This application is a continuation-in-part (CIP) application of U.S. patent application Ser. No. 11/833,819, filed on Aug. 3, 2007 now abandoned, which is herein incorporated by reference in its entirety.

FIELD OF THE INVENTION

The subject matter herein relates to locomotives, and, more particularly, to a locomotive truck for distributing weight asymmetrically to the axles of the truck.

BACKGROUND OF THE INVENTION

A diesel-electric locomotive typically includes a diesel internal combustion engine coupled to drive a rotor of at least one traction alternator to produce alternating current (AC) electrical power. The traction alternator may be electrically coupled to power one or more electric traction motors mechanically coupled to apply torque to one or more axles of the locomotive. The traction motors may include AC motors operable with AC power, or direct current motors operable with direct current (DC) power. For DC motor operation, a rectifier may be provided to convert the AC power produced by the traction alternator to DC power for powering the DC motors.

AC-motor-equipped locomotives typically exhibit better performance and have higher reliability and lower maintenance than DC motor equipped locomotives. In addition, more responsive individual motor control may be provided in AC-motor-equipped locomotives, for example, via use of inverter-based motor control. However, DC-motor-equipped locomotives are relatively less expensive than comparable AC-motor-equipped locomotives. Thus, for certain hauling applications, such as when hauling relatively light freight and/or relatively short trains, it may be more cost efficient to use a DC-motor-equipped locomotive instead of an AC-motor-equipped locomotive.

For relatively heavy hauling applications, diesel-electric locomotives are typically configured to have two trucks including three powered axles per truck. Each axle of the truck is typically coupled, via a gear set, to a respective motor mounted in the truck near the axle. Each axle is mounted to the truck via a suspension assembly that typically includes one or more springs for transferring a respective portion of a locomotive weight (including a locomotive body weight and a locomotive truck weight) to the axle while allowing some degree of movement of the axle relative to the truck.

A locomotive body weight ($W_{loco}$) is typically configured to be about equally distributed between the two trucks. The locomotive weight is usually further configured to be symmetrically distributed among the axles of the trucks. In an example, where $W_{loco}$=420,000 pounds, the locomotive truck arrangement is typically configured to equally distribute the weight to the six axles of the locomotive, so that each axle supports a force of $W_{loco}/6$ pounds per axle, (e.g., 70,000 pounds per axle).

Locomotives are typically manufactured to distribute weight symmetrically to the trucks and then to the axles of the trucks so that relatively equal portions of the weight of the locomotive are distributed to the axles. Typically, the weight of the locomotive and the power rating of the locomotive determine a tractive effort capability rating of the locomotive that may be expressed as weight times a tractive effort rating. Accordingly, the weight applied to each of the axles times the tractive effort that can be applied to the axle determines a power capability of the corresponding axle. Consequently, the heavier a locomotive, the more tractive effort that it can generate at a certain speed. Additional weight, or ballast, may be added to a locomotive to bring it up to a desired overall weight for achieving a desired tractive effort capability rating. For example, due to manufacturing tolerances that may result in varying overall weights among locomotives built to a same specification, locomotives are commonly configured to be slightly lighter than required to meet a desired tractive effort rating, and then ballast is added to reach a desired overall weight capable of meeting the desired tractive effort rating.

Diesel engine powered locomotives represent a major capital expenditure for railroads, including both the initial purchase of a locomotive, but also the ongoing expense of maintaining and repairing the locomotive. In addition, hauling requirements may change over time for the railroad, so that a locomotive having a certain operating capability at a time of purchase may not meet the hauling needs of the railroad in the future. For example, a railroad looking to purchase a locomotive may only have minimal hauling needs that may be met by a relatively inexpensive low tractive effort capability locomotive, such as a DC powered locomotive having less hauling capability compared to a more expensive relatively high tractive effort locomotive, such as an AC powered locomotive. However, at some point in the useful life of the low tractive effort capability locomotive, hauling needs of the railroad may change, such that the low tractive effort capability locomotive may not be able to provide sufficient hauling capability. As a result, the railroad may need to purchase a more capable high tractive effort capability locomotive, thereby sacrificing a remaining useful life of the low tractive effort capability locomotive.

The inventors have recognized that by manufacturing one type of an item, instead of various different types of the item, a manufacturer may be able to reduce manufacturing costs by streamlining production lines. For example, a locomotive manufacturer may be able to reduce manufacturing costs by producing a single type of locomotive, such as a high tractive effort capability AC powered locomotive, instead of producing two types of locomotives, such as a high tractive effort capability AC powered locomotive and a low tractive effort capability DC powered locomotive.

What is needed is a locomotive that, for example, may be easily reconfigured as operating requirements for the locomotive change over its life. There is also a continuing need to reduce manufacturing costs. What is also needed is a locomotive truck that allocates weight differently to un-powered and powered axles, for example, of such a locomotive. Accordingly, the inventors have innovatively developed a reconfigurable locomotive that includes trucks that innovatively shift weight from an un-powered axle to a powered axle to achieve a desired tractive effort rating and/or an adhesion rating not achievable with symmetrically weighted axles.

BRIEF SUMMARY OF THE INVENTION

An example embodiment of the invention includes a locomotive (or other rail vehicle) truck for distributing weight asymmetrically to axles of the truck. The truck includes a first axle uncoupled from a traction system of the locomotive and a first suspension assembly coupling the first axle to the truck for applying to the first axle a first portion of a locomotive weight. The truck also includes a second axle coupled to the traction system of the locomotive and a second suspension assembly. The second suspension assembly couples the second axle to the truck for applying a second portion of the locomotive weight to the second axle. The second portion of the locomotive weight is greater than the first portion of the locomotive weight so that weight is asymmetrically distributed to the first axle and the second axle, and so as to transmit a corresponding incremental amount of tractive effort for a given amount of a driving torque applied to the second axle via the traction system of the locomotive.

In another example embodiment, the invention includes a locomotive (or other rail vehicle) truck for distributing weight asymmetrically to axles of the truck. The truck includes a first axle uncoupled from a traction system of the locomotive and a first suspension assembly coupling the first axle to the truck for applying a first portion of a locomotive weight to the first axle. The truck also includes a second axle coupled to the traction system of the locomotive and a second suspension assembly coupling the second axle to the truck for applying a second portion of the locomotive weight to the second axle. The truck also includes a third axle coupled to the traction system of the locomotive and a third suspension assembly coupling the third axle to the truck for applying a third portion of the locomotive weight to the third axle. The second and third portions of the locomotive weight applied to the respective second axle and third axle and are greater than the first portion of the locomotive weight being applied to the first axle so that weight is asymmetrically distributed to the first axle, the second axle, and the third axle, and so as to transmit a corresponding incremental amount of tractive effort for a given amount of a driving torque applied to the second axle and third axle via the traction system of the locomotive. The axle weight distribution comprises a relatively slight weight distribution compared to a nominal weight normally carried by the axles.

In another example embodiment, the invention includes a method for distributing weight asymmetrically to axles of a locomotive (or other rail vehicle) truck. The method includes uncoupling a first axle of the locomotive truck from a traction system of the locomotive and coupling the first axle to the truck with a first suspension assembly for applying a first portion of a locomotive weight to the first axle. The method also includes coupling a second axle of a locomotive truck to the traction system of the locomotive and coupling the second axle to the truck with a second suspension assembly for applying a second portion of the locomotive weight to the second axle. The second portion of the locomotive weight is greater than the first portion of the locomotive weight that is applied to the first axle so that weight is asymmetrically distributed to the first axle and the second axle, and so as to transmit a corresponding incremental amount of tractive effort for a given amount of a driving torque applied to the second axle via the traction system of the locomotive.

BRIEF DESCRIPTION OF THE DRAWINGS

A more particular description of the invention briefly described above will be rendered by reference to specific embodiments thereof that are illustrated in the appended drawings. These drawings depict only typical embodiments of the invention and are not therefore to be considered to be limiting of its scope.

DETAILED DESCRIPTION OF THE INVENTION

Figure 1A:
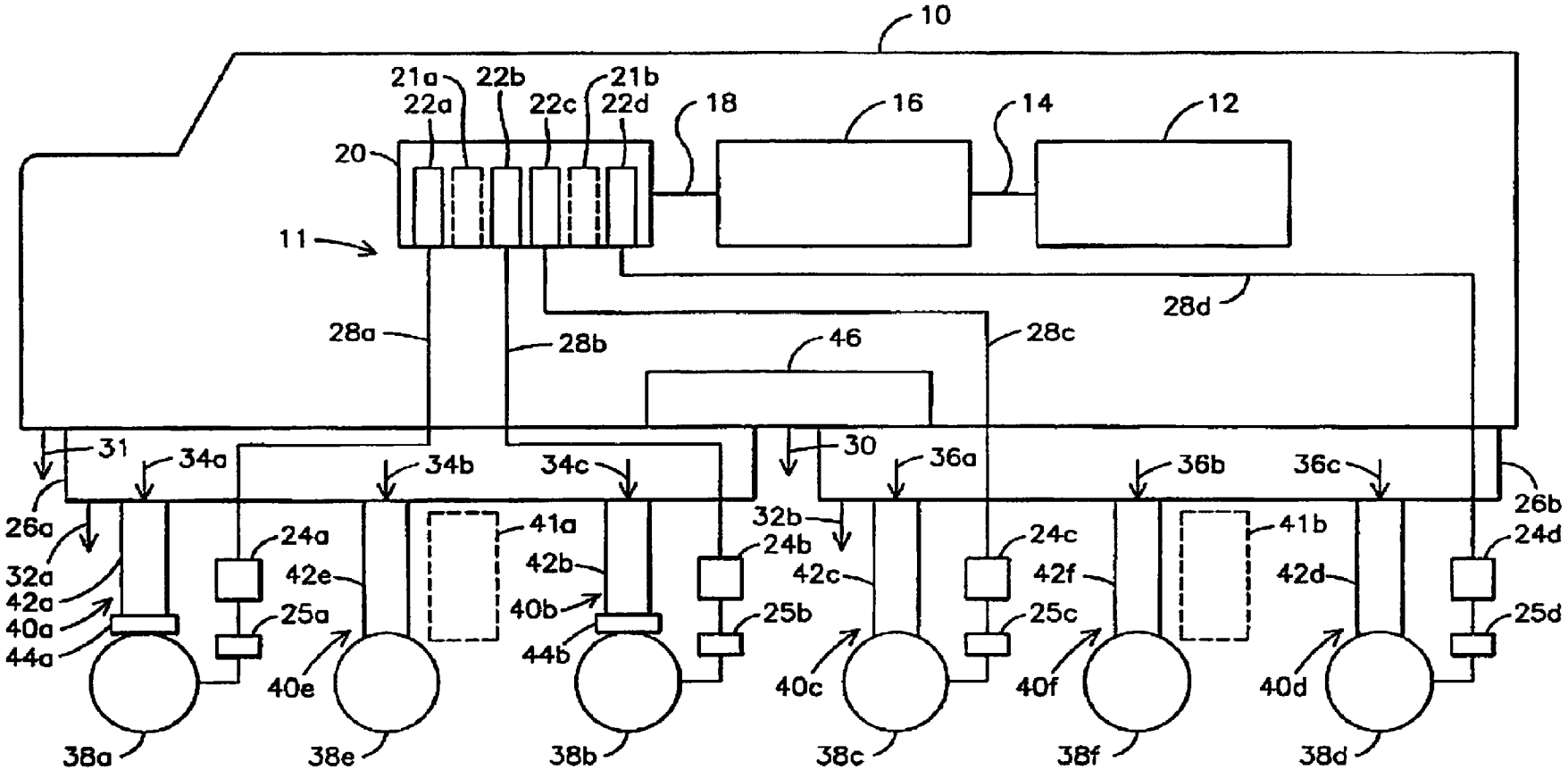
FIG. 1A is a schematic block diagram of an example embodiment of a reconfigurable locomotive having a truck for distributing a locomotive truck weight asymmetrically to axles of the locomotive.

Reference will now be made in detail to the embodiments consistent with the invention, examples of which are illustrated in the accompanying drawings. Wherever possible, the same reference numerals are used throughout the drawings and refer to the same or like parts.

FIG. 1A is a schematic block diagram of an example embodiment of a reconfigurable locomotive 10. The locomotive 10 may include a traction system 11 having a diesel internal combustion engine 12 coupled via shaft 14 to drive a traction alternator 16 for producing AC electrical power 18. The AC electrical power 18 may be provided to a motor controller 20 that may include one or more inverters 22*a*-22*d*. Inverters 22*a*-22*d* may be configured for providing electrical power to, and for controlling respective traction motors 24*a*-24*d* located in trucks 26*a*-26*b*. The inverters 22*a*-22*d* may be electrically coupled to the respective traction motors 24*a*-24*d* with wiring harnesses 28*a*-28*d*. In an aspect of the invention, the traction motors 24*a*-24*d* may include AC powered traction motors for converting AC electrical power into a mechanical power. The traction motors 24*a*-24*d* may be mechanically coupled to respective gear sets 25*a*-25*d* for applying power in the form of driving torque to a corresponding powered axle 38*a*-38*d*. It should be understood that although an AC type locomotive system is described above, aspects of the present invention may also be used with DC locomotives and other locomotive power configurations as well.

A static weight 30 of the locomotive 10, for example, including a locomotive body weight 31 and truck weights 32*a*, 32*b*, is supported by the axles 38*a*-38*f* of the trucks 26*a*-26*b*. Accordingly, the static weight 30 supported by any one axle may include a portion of the locomotive body weight 31 of the locomotive 10 supported by the truck to which the axle is coupled and the truck weight, e.g., truck weight 32*a*, 32*b*. The axles 38*a*-38*f* may be coupled to the trucks 26*a*, 26*b* by one or more suspension assemblies 40*a*-40*f* that may include one or more springs 42*a*-42*f* and/or shims 44*a*, 44*b*.

In an embodiment, each of the axles of the trucks has substantially the same weight/normal force capability. This means that all the axles have substantially equal weight-carrying capability, meaning equal but for standard manufacturing tolerances or nominal deviations, as will be readily understood by one skilled in the art. It will be appreciated that the total axle weight has both static and dynamic components, which in one example embodiment may combine to yield values on the order of approximately 120% of a nominal static weight. It will be appreciated that the magnitude of the static weight distribution achieved in accordance with aspects of the present invention will not require any structural modifications for the axles of the truck to accommodate the magnitude of the static weight distribution. This means that the axles are structurally the same, subject to standard manufacturing tolerances or nominal deviations, as will be readily understood by one skilled in the art.

In an aspect of the invention, one or more axles of trucks 26*a*, 26*b*, such as axles 38*e*, 38*f*, may be left un-powered in a baseline configuration. Consequently, the associated assemblies normally deployed with the un-powered axles, such as inverters, traction motors, and/or gear sets, may be absent in a baseline configuration. By reducing a number of traction components, users requiring a less tractive effort capable and/or less powerful locomotive may be able to save on the cost of purchasing such a locomotive compared to a locomotive having a full complement of traction components. Furthermore, manufacturers of such locomotives may save on production costs because they only need to produce one baseline locomotive design and simply add traction components and/or refrain for installing traction components to achieve a desired capability of a locomotive, instead of having to produce entirely different models having different capabilities. Spaces in the locomotive 10 normally occupied by components of the traction system 11, such as a space 41*a* in the truck 26*a* normally reserved for housing a traction assembly, and/or a space 21 (e.g., space 21*a* or another space 21*b*) in the motor controller 20, normally reserved for an inverter, may be left vacant in a baseline locomotive design.

Figure 1B:
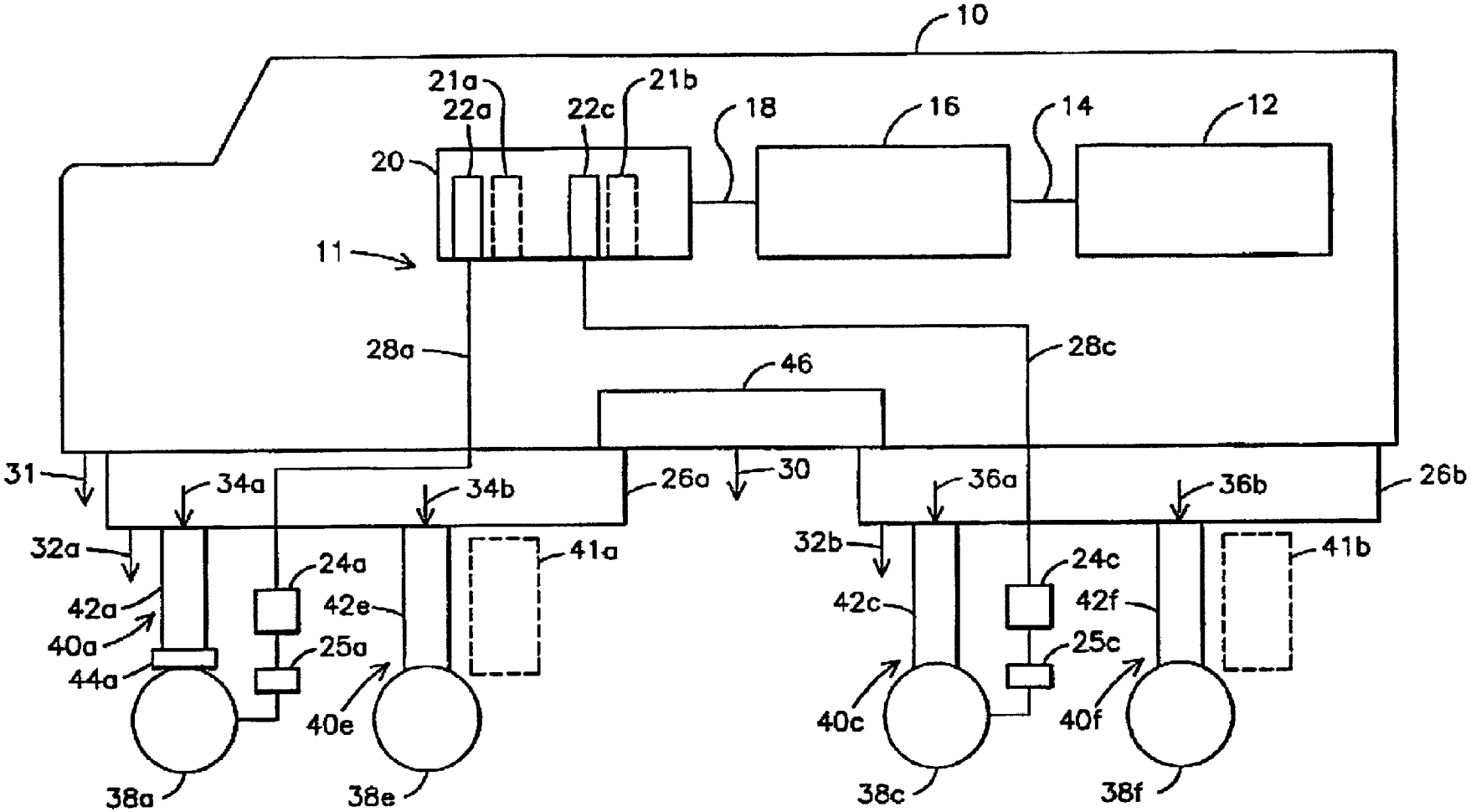
FIG. 1B is a schematic block diagram of an example embodiment of a reconfigurable locomotive having a truck for distributing a locomotive truck weight asymmetrically to axles of the locomotive.

An example embodiment of the invention, shown in FIG. 1B, relates to a locomotive truck, e.g., truck 26*a*, for distributing a locomotive truck weight asymmetrically to axles, e.g., a first axle 38*a* and a second axle 38*e*, of the truck 26*a*. Axle 38*e* of a locomotive truck 26*a* may be uncoupled from the traction system 11 of the locomotive 10 and a suspension assembly 40*e* may couple axle 38*e* to the truck 26*a* for applying a first portion 34*b* of the weight 30 of the locomotive 10 to axle 38*e*. For example, truck 26*a* may be configured without a motor or gear set normally used for powering axle 38*e*. Accordingly, axle 38*e* may be configured to act as an un-powered, idler axle that functions to support portion 34*b* of the locomotive weight 30 in the absence of the traction system components normally needed to drive the axle 38*e* (and, with respect to the truck 26*b*, axle 38*f* may be configured to act as an un-powered, idler axle that functions to support portion 36*b* of the locomotive weight 30 in the absence of the traction system components normally needed to drive the axle 38*f*). Axle 38*a* of the locomotive truck 26*a* may be coupled to the traction system 11, and a suspension assembly 40*a* may couple the axle 38*a* to the truck 26*a* for applying a second portion 34*a* of the weight 30 being applied by the locomotive 10 to the axle 38*a* (and, with respect to the truck 26*b*, applying a second portion 36*a* of the weight 30 being applied by the locomotive 10). The portion 34*b* of the weight 30 may be different from the portion 34*a* of the weight 30 being applied to the axle 38*a* so that the locomotive weight 30 is asymmetrically distributed to axle 38*e* and axle 38*a*. This asymmetrical distribution of the weight 30 may be configured to allocate more weight to axle 38*a* so as to transmit a corresponding incremental amount of tractive effort for a given amount of a driving torque applied to the axle 38*a* via the traction system 11 of the locomotive 10. The first axle comprises an axle similar in capacity to the second axle. For example, in the event the locomotive were to be reconfigured so that the first axle is coupled to the traction system of the locomotive, the first axle can accept and withstand tractive effort from the traction system of the locomotive.

In an embodiment, the portion 34*a* of the weight 30 applied to axle 38*a* coupled to the traction system 11 may be greater than portion 34*b* of the weight 30 applied to the axle 38*e* uncoupled from the traction system so that more weight is allocated to axle 38*a*. Accordingly, weight may be transferred from an un-powered axle 38*e* that does not provide tractive effort, to a powered axle 38*a* so that more tractive effort may be generated by axle 38*a* compared to a conventional configuration wherein the weight 30 is symmetrically distributed to the axles 38*a*, 38*b*. For example, if 5000 pounds of weight normally applied to axle 38*e* is relieved from bearing on axle 38*e* and allocated to axle 38*a*, an additional tractive effort proportional to the additional 5000 pounds allocated to axle 38*a* may be transmitted by axle 38*a*. Advantageously, by allocating more weight to the powered axle 38*a*, adhesion control may be improved compared to an arrangement wherein weight is symmetrically allocated to the axles 38*a* and 38*e*.

In an example embodiment for distributing weight asymmetrically, suspension assembly 40*a* and suspension assembly 40*e* may comprise respective springs 42*a*, 42*e* having different characteristics that provide different weight loading responses. For example, the different characteristics may comprise different spring constants and/or different spring geometries. For example, spring 42*a* may comprise a stiffer spring constant than a spring constant of spring 42*e*. In another embodiment, the different spring geometry may include a different spring length in a direction of spring compression. For example, a length of spring 42*a* may be longer than a length of spring 42*e*.

In another embodiment, suspension assembly 40*a* and suspension assembly 40*e* may include respective springs 42*a*, 42*e* having equivalent characteristics, wherein at least one of the suspension assembly 40*a* and suspension assembly 40*e* include a shim, e.g. shim 44*a*, for configuring the corresponding suspension assembly, e.g., suspension assembly 40*a*, to have a different characteristic than the other suspension assembly, e.g., suspension assembly 40*e*. For example, shim 44*a* may effectively shorten, or pre-compress, spring 42*a* so that more weight is allocated to axle 38*a* compared to an un-shimmed suspension assembly 40*e* including a spring 42*e* having an equivalent characteristic as spring 42*a*. In another aspect of the invention, a smaller wheel diameter of a less weighted axle 38*e* compared to a wheel diameter of a more weighted axle 38*a* may be initially proved due to the fact that the more weighted axle 38*a* will wear faster.

In yet another embodiment depicted in FIG. 1A, the locomotive truck may include a third axle, e.g., axle 38*b*, coupled to the traction system 11 of the locomotive 10 and another suspension assembly 40*b* coupling axle 38*b* to the truck 26*a* for applying a third portion 34*c* of the weight 30 to the axle 38*b*. Portion 34*c* applied to the axle 38*b* may be different from portion 34*b* applied to axle 38*e* so that the weight 30 is asymmetrically distributed to axle 38*a*, axle 38*e*, and axle 38*b*. The asymmetrical distribution may be configured to allocate more weight to axle 38*a* and axle 38*b* so as to transmit a corresponding incremental amount of tractive effort for a given amount of a driving torque applied to axle 38*a* and axle 38*b* via the traction system 11 of the locomotive 10. For example, portion 34*a* and portion 34*c* applied to the respective axle 38*a* and axle 38*b* may be greater than the portion 34*b* of the weight 30 applied to axle 38*e*, so that more weight is allocated to axle 38*a* and axle 38*b* (and, with respect to truck 26*a*, portion 36*a* and portion 36*c* applied to the respective axle 38*c* and axle 38*d* may be greater than the portion 36*b* applied to axle 38*f* so that more weight is allocated to axle 38*c* and axle 38*d*). In another aspect, the weights allocated to axle 38*a* and axle 38*b* may be symmetric with respect to each other, but different than the weight allocated to axle 38*e*.

The examples below represent asymmetrical axle weight distribution in accordance with aspects of the present invention, where the values are listed in a descending numerical order regarding the magnitude of asymmetrical axle weight distribution. In a first example, the asymmetrical axle weight distribution may be represented by the following weight axle ratios, 74/60/74. It is believed that the ratios of the first example may approximate an upper bound that takes into account various considerations regarding the extent to which static weight can be practically shifted to the powered axles. These considerations may include rail forces, the impact on friction braking related wheel to rail adhesion required to avoid slides, as well as truck component stress.

In a second example, the asymmetrical axle weight distribution may be represented by the following weight axle ratios, 72/64/72. In a third example, the normalized asymmetrical axle weight distribution may be represented by the following weight axle ratios 70/68/70. It is believed that the distribution values of the third example may approximate a lower bound regarding static weight shifting of practical utility. It will be appreciated that the foregoing values (upon rounding) correspond to an example range from approximately 55%/45% weight distribution to approximately 51%/49% distribution, where a second axle coupled to the traction system carries the larger percentage relative to a first axle uncoupled from the traction system. It will be appreciated that the foregoing values (upon rounding) in a three-way percentage distribution correspond to a range from approximately 33.6%, 32.7%, 33.6% to approximately 35.5%, 29.0%, 35.5%, where a second axle and a third axle coupled to the traction system carry the larger percentage values relative to a first axle uncoupled from the traction system, and where the first axle is positioned between the second and the third axles. The first axle comprises an axle similar in capacity to the second and third axles. For example, in the event the locomotive were to be reconfigured so that the first axle is coupled to the traction system of the locomotive, the first axle can accept and withstand tractive effort from the traction system of the locomotive.

In view of the foregoing considerations, it will be appreciated that the weight distribution achieved in accordance with aspects of the present invention represents a relatively slight weight distribution compared to a nominal weight normally carried by the axles, and as noted above, this means that all the axles have the same weight-carrying capability, subject to manufacturing tolerances or nominal deviations, as will be understood by one skilled in the art.

In another embodiment, suspension assemblies 40*a*, 40*e* and 40*b*, include respective springs 42*a*, 42*e* and 42*b* having different characteristics. The different characteristics may include different spring constants and/or different characteristics comprise different spring geometries. For example, spring 42*a* may comprise a stiffer spring constant than a spring constant of spring 42*e*. In another embodiment, the different spring geometry may include a different spring length in a direction of spring compression. For example, a length of spring 42*a* may be longer than a length of spring 42*e* In another example embodiment, springs 42*a*, 42*e* and 42*b* may include equivalent characteristics, wherein at least one of the first suspension assemblies 40*a*, 40*e* and 40*b* include a shim, such as shims 44*a*, 44*b* for configuring the corresponding suspension assembly e.g., suspension assembly 40*a*, 40*b* to have different characteristics than the other suspension assembly, e.g., suspension assembly 40*e*. For example, shim 44*a* may effectively shorten, or pre-compress, spring 42*a* so that more weight is allocated to axle 38*a* compared to an un-shimmed suspension assembly 40*e* including a spring 42*e* having an equivalent characteristic as spring 42*a*.

In another example embodiment, an amount and/or position of a ballast 46 on the locomotive 10 relative to the trucks 26*a*, 26*b* may be configured responsive to a number of axles coupled to the traction system 11 in the trucks 26*a*, 26*b*. For example, referring to FIG. 1B, if truck 26*a* has its two axles 38*a*, 38*e* coupled to the traction system 11, and truck 26*b* has axle 38*c* coupled to the traction system 11 and axle 38*f* uncoupled from the traction system 11, then the ballast 46 may be positioned on the locomotive 10 so that it is closer to truck 26*a* than 26*b*. Accordingly, the position of the ballast 46 may be configured to asymmetrically apply more of the weight to truck 26*a* to allow transmitting a corresponding incremental amount of tractive effort for a given amount of a driving torque applied to the coupled axles of truck 26*a* via the traction system 11 of the locomotive 10.

Figure 2:
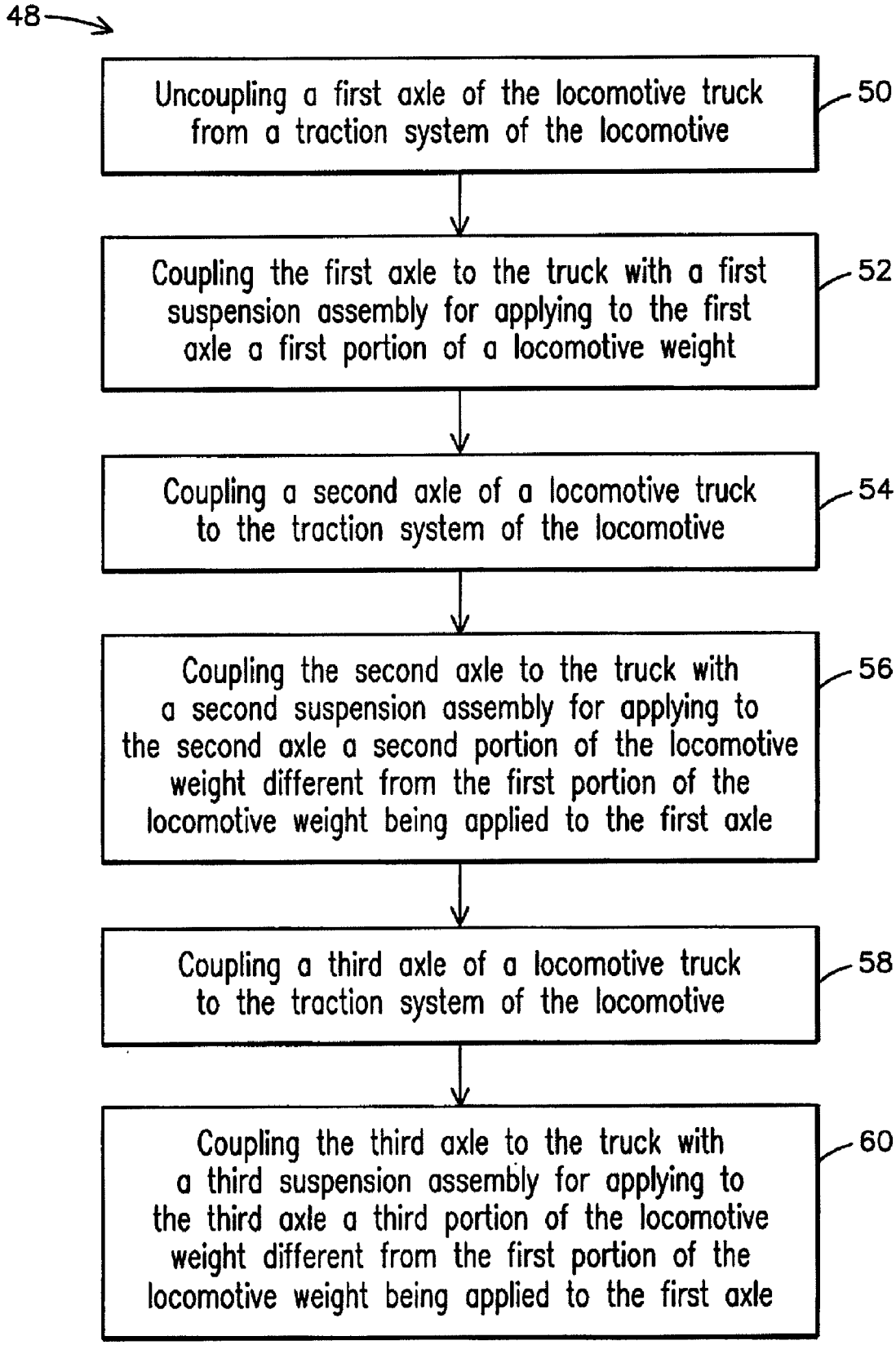
FIG. 2 is a flow diagram of an example embodiment of a method for distributing weight asymmetrically to axles of locomotive.

In another example embodiment depicted in the flow diagram 48 of FIG. 2, and with reference to FIG. 1A and FIG. 1B, a method for distributing a locomotive weight 30 asymmetrically to axles thereof may include uncoupling 50 axle 38*e* of the locomotive truck 26*a* from the traction system 11 of the locomotive 10. The method may also include coupling 52 axle 38*e* to the truck 26*a* with a first suspension assembly 40*e* for applying a first portion 34*b* of a locomotive weight 30 to the axle 38*e*. The method may also include coupling 54 axle 38*a* to the traction system 11, and then coupling 56 axle 38*a* to the truck 26*a* with a second suspension assembly 40*a* for applying a second portion 34*a* of the locomotive weight 30 to axle 38*a* that is different from, such as greater than, portion 34*b* of the locomotive weight 30 being applied to axle 38*e* so that weight is asymmetrically distributed to axle 38*a* and axle 38*e*. In an aspect of the inventions, the asymmetrical distribution is configured to allocate more of the weight 30 to axle 38*a* so as to transmit a corresponding incremental amount of tractive effort for a given amount of a driving torque applied to axle 38*a* via the traction system 11 of the locomotive 10.

The method may further include coupling 58 a third axle, e.g. axle 38*b* of the locomotive truck 26*a* to the traction system 11 of the locomotive 10 and coupling 60 axle 38*b* to the truck 26*a* with a third suspension assembly for applying a third portion 34*c* of the weight 30 to axle 38*b* that is different from, such as greater than, the first portion 34*b* of the weight 30 being applied to axle 38*e*.

In an embodiment of a rail vehicle truck, each of two or more axles in a truck (e.g., the truck may have two or three axles) includes at least one traction wheel that contacts the rail(s) or other guideway over which the rail vehicle travels, wherein: (i) each such traction wheel is driven through rotation of the axle to which it is attached for moving the rail vehicle along the rail(s) or other guideway, e.g., the axle may be rotated by a traction motor that drives a gear system attached to the axle; and (ii) each such traction wheel has substantially the same outer diameter, meaning the same but for manufacturing variances and operational wear. In another embodiment, all the support wheels of a rail vehicle (meaning all wheels which support rail vehicle weight and contact an underlying rail(s) or other guideway over which the rail vehicle travels) have substantially the same outer diameter.

Although embodiments of the invention have been described herein with reference to locomotives, all the embodiments and teachings set forth herein are applicable to rail vehicles more generally ("rail vehicle" referring to a vehicle that travels along a rail or set or rails or other guideway).

While exemplary embodiments of the invention have been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rail vehicle comprising:

a first truck that includes:

a first axle uncoupled from a traction system of the rail vehicle;

a first suspension assembly coupling the first axle to the first truck, the first suspension assembly having respective mechanical characteristics to apply a first portion of a rail vehicle weight to the first axle of the first truck;

a second axle coupled to the traction system of the rail vehicle; and a second suspension assembly coupling the second axle to the first truck, the second suspension assembly having respective mechanical characteristics different than the mechanical characteristics of the first suspension assembly to apply a second portion of the rail vehicle weight to the second axle, the second portion of the rail vehicle weight being greater than the first portion of the rail vehicle weight so that the rail vehicle weight is asymmetrically distributed to the first axle and the second axle to transmit a corresponding incremental amount of tractive effort for a given amount of a driving torque applied to the second axle via the traction system of the rail vehicle, wherein the first axle and the second axle comprise axles having substantially equal weight-carrying capability;

a second truck comprising a third axle and a fourth axle coupled to the traction system; and a rail vehicle ballast disposed on the rail vehicle closer to the second truck than the first truck so that the rail vehicle weight is asymmetrically distributed to the second truck and the first truck so as to allow transmitting a corresponding incremental amount of tractive effort for a given amount of a driving torque applied to the third axle and fourth axle of the second truck via the traction system of the rail vehicle.

2. The rail vehicle of claim 1, wherein the first suspension assembly and the second suspension assembly comprise respective springs having different characteristics.

3. The rail vehicle of claim 2, wherein the different characteristics comprise different spring constants.

4. The rail vehicle of claim 2, wherein the different characteristics comprise different spring geometries.

5. The rail vehicle of claim 1, wherein the first suspension assembly and the second suspension assembly comprise respective springs having equivalent characteristics, at least one of the first suspension assembly and the second suspension assembly further comprising a shim for configuring the corresponding suspension assembly to have a different characteristic than the other suspension assembly.

6. The rail vehicle of claim 1, wherein the rail vehicle weight comprises a rail vehicle body weight of the rail vehicle supported by at least one of the first truck or the second truck and weight of at least one of the first truck or the second truck.

7. The rail vehicle of claim 1, wherein the traction system comprises an alternating current traction motor.

8. The rail vehicle of claim 1, wherein an asymmetrical weight distribution to the second axle and the first axle comprises a range from 55%/45% weight distribution to 51%/49% weight distribution.

9. The rail vehicle of claim 1, wherein the first axle and the second axle comprise axles have equivalent weight-carrying capabilities.

* * * * *

UNITED STATES PATENT AND TRADEMARK OFFICE

CERTIFICATE OF CORRECTION

PATENT NO. : 8,371,231 B2
APPLICATION NO. : 12/712469
DATED : February 12, 2013
INVENTOR(S) : Kumar et al.

It is certified that error appears in the above-identified patent and that said Letters Patent is hereby corrected as shown below:

In the Specification:

In Column 3, Line 26, delete “weight” and insert -- weight are --, therefor.

In Column 7, Line 49, delete “42e” and insert -- 42e. --, therefor.

In the Claims:

In Column 10, Line 32, in Claim 9, delete “have” and insert -- having --, therefor.

Signed and Sealed this
Fourteenth Day of May, 2013

Teresa Stanek Rea

Teresa Stanek Rea
*Acting Director of the United States Patent and Trademark Office*